United States Patent [19]

Kato

[11] Patent Number: 4,633,794

[45] Date of Patent: Jan. 6, 1987

[54] DEVICE FOR DETECTING FABRIC THICKNESS OF A SEWING MACHINE

[75] Inventor: Kenji Kato, Hachioji, Japan

[73] Assignee: Janome Sewing Machine Co., Ltd., Tokyo, Japan

[21] Appl. No.: 835,560

[22] Filed: Mar. 3, 1986

[30] Foreign Application Priority Data

Mar. 13, 1985 [JP] Japan ..... 60-34719[U]

[51] Int. Cl.[4] ..... D05B 19/00

[52] U.S. Cl. ..... 112/121.11; 112/270

[58] Field of Search ..... 112/121.11, 122.11, 112/254, 272, 270, 453, 255, 235; 340/675, 551; 271/258, 262; 26/17; 28/227

[56] References Cited

U.S. PATENT DOCUMENTS

| | | | |
|---|---|---|---|
| 3,976,019 | 8/1976 | Allen et al. | 112/121.11 X |
| 4,166,423 | 9/1979 | Brienza et al. | 112/254 |
| 4,258,326 | 3/1981 | Johne | 271/258 X |
| 4,276,547 | 6/1981 | Bowen | 340/675 |
| 4,301,757 | 11/1981 | Tonomura | 112/254 |
| 4,565,143 | 1/1986 | Hanyu et al. | 112/272 X |

*Primary Examiner*—Peter Nerbun

*Attorney, Agent, or Firm*—Michael J. Striker

[57] ABSTRACT

A detecting device for detecting a thickness of a fabric inserted between a presser foot and a needle plate of a sewing machine includes an electric iron core having an electric coil and inserted at a space between the needle plate and the fabric presser foot, into which a fabric under stitching is fed. Said space is changed by the fabric thickness. The device detects a change in said space and calculates a length of the changed space.

5 Claims, 3 Drawing Figures

DEVICE FOR DETECTING FABRIC THICKNESS OF A SEWING MACHINE

BACKGROUND OF THE INVENTION

The present invention relates to a device for detecting thickness of a fabric to be stitched in a sewing machine, the device serving as a means for obtaining information about the fabric thickness and automatically controlling of a thread tension.

There has been conventionally proposed a method for obtaining signals of upper and lower positions of a presser bar lifting lever by means of a potentiometer for automatically giving information about the fabric thickness to a computer circuit of the sewing machine.

A further method has been proposed for inputting numerical stepwise information in response to a thickness of thin, medium and thick fabrics by means of key operations for giving fixed information about the fabric thickness to the computer circuit.

However, when an exchangeable presser foot is used, a standard point of the upper and lower positions of the lifting lever of the presser bar is changed due to differences in plate thicknesses of the metallic presser foot. Therefore, an adjustment should be effected at a zero point for detecting the fabric thickness each time when the presser foot is exchanged.

On the other hand, the above mentioned further method has not satisfied all requirements, because it could not exactly follow changings of the fabric thicknesses during stitching as thickness varies.

SUMMARY OF THE INVENTION

It is an object of the present invention to provide an improved device for detecting fabric thickness.

The fabric during stitching by a sewing machine is fed into a space defined between a needle plate and a presser foot, either of which is magnetizable. According to the invention, an electric iron core having an electric coil is provided at the space.

The space is changed along its length by thicknesses of fabrics under stitching, so that a coefficient relation between energization and a magnetic flux of said coil are changed accordingly.

Herein, changing of the space length and changing of the coefficient relation have been predetermined experimentally.

A device according to the invention detects a change in the fabric thickness of fabric at a detecting part thereof, and calculates the space length at a calculating part thereof in response to the change of said predetermined space length and the change of the coefficient relation.

For accomplishing the operation, the device of this invention is provided with an iron core wound with a coil thereon and having a pair of magnetic poles in opposition to a magmetizable member through the space; a detecting part for changes in a space length; and calculating part for the fabric thickness.

DETAILED DESCRIPTION OF THE PREFERRED EMBODIMENTS

Figure 1:
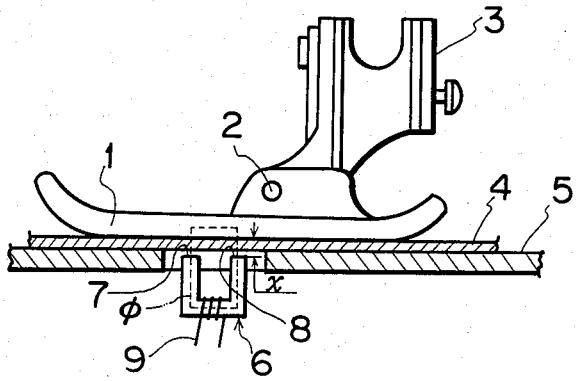
FIG. 1 is a cross sectional view of a device according to the invention.

An exemplified embodiment of the invention will be explained with reference to the drawing. In FIG. 1, a presser foot 1 comprises a magnetizable substance, and is pivoted to a presser holder 3 via a pin 2 thereof. The presser foot 1 may be exchanged in accordance with kinds of the fabrics or stitches utilized. A fabric 4 to be stitched is fed between the presser foot 4 and a needle plate 5 by means of a feed dog (not shown). An electric iron core 6 is secured to a machine body (not shown) holding the needle plate 5, in opposition to the presser foot 1, and magnetic poles 7, 8 thereof face the presser foot 1. Poles 7 and 8 are spaced from presser foot 1 by a space (space length x) including the fabric 4. An electric coil 9 wound on the core 6 detects the space length x.

Figure 2:
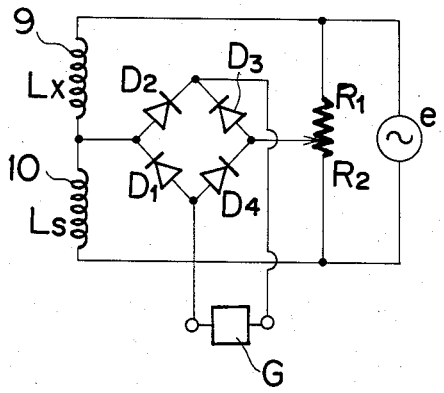
FIG. 2 is a circuit diagram of a detecting part.

A circuit for a detecting part shown in FIG. 2 is composed of the electric coil 9, a coil 10 having a proper inductance Ls equivalent to the maximum value of an inductance Lx of the coil 9, and a bridge circuit having resistances R1, R2. This circuit receives AC power source e. The current by voltage difference between a connection between coils 9, 10 and a connection between the resistances R1, R2 is full-wave rectified by diodes D1 to D4, and output from a detecting part G.

In a magnetic path of a magnetic flux $\phi$ in FIG. 1, assuming that the length of the magnetic path between the presser foot 1 and the iron core 6 is 1, the magnetic permeability thereof is $\mu$, a magnetic permeability of the air is $\mu_0$, a cross sectional area of the magnetic path is S (which is, in this case, a cross sectional area of the space length x equivalently), and a winding number of the electric coil 9 is N, the relation between the space length x and the inductance Lx of the coil 9 will be expressed with a formula:

$$Lx=SN^2/[(1/\mu)+(2x/\mu_0)]=\mu_0SN^2/(2x).$$

ps Therefore, when the space length x is changed into $x+\Delta x$, the inductance $Lx+\Delta Lx$ will be expressed with a formula:

$$Lx+\Delta Lx=\mu_0SN^2/[2(x+\Delta x)]=[\mu_0SN^2/(2x)](1-\Delta x/x).$$

Thus, the relation, with the changing number $\Delta Lx$, of the inductance Lx due to the changing amount $\Delta x$ of the space length x will be expressed with a formula:

$$\Delta Lx=-[\mu_0SN^2/(2x^2)]\Delta x.$$

Therefore, the changing amount $\Delta Lx$ of the inductance Lx is in proportion with the changing amount $\Delta x$ of the space length x.

A coil 10 of FIG. 2 is applied with the inductance Ls which is a proper inductance and is almost equivalent to the maximum value of the inductance Lx of the coil 9 when the space length x is minimal with the fabric 4 removed. On the other hand, the resistances R1, R2 are adjusted at the connection with the detecting part G so that a detected value thereof is 0 when the space length x is minimal.

Figure 3:
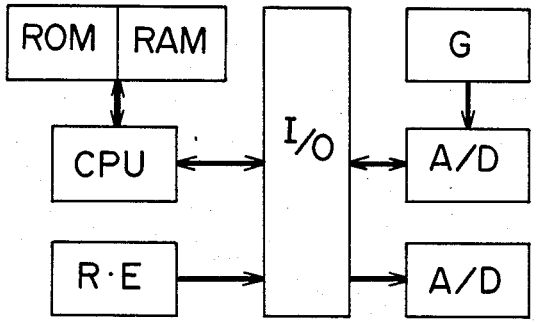
FIG. 3 is a block diagram of a calculating part of the device.

FIG. 3 shows the block diagram of the calculating part, in which a microcomputer is composed of a central processing unit (CPU), a read-only-memory (ROM), a random-access-memory (RAM) and an inputoutput device (I/O). A detecting value of the detecting part G is given to a microcomputer circuit via an analog-digital converter (A/D). Each time when receiving a detecting signal of a determined phase from a rotary encorder (R.E) for detecting a rotation phase of the main shaft of the sewing machine, the microcomputer circuit calculates the fabric thickness by means of the detected value of the detecting part G in dependence upon coefficients obtained in advance experimentally with respect to the relation of said detected value and the space length x, and gives results of said calculation to a thread tension automatic adjuster (DV) which is conventional.

A further reference will be made to an actuation of the above mentioned structure. When the fabric 4 is not placed between the presser foot and the needle plate, the space length x is the minimal, the bridge of FIG. 2 is in equilibrium, and a detected value of the detecting part CG is zero.

When the fabric 4 is inserted between presser foot 1 and needle plate 5, the space length x is maximal, the magnetic flux $\phi$ is decreased, and the inductance Lx of the electric coil 9 is decreased. Therefore, each time of half-wave of AC power source e, an unbalanced current is generated which passes through the electric coil 9, the diode D2, the detecting part G, the diode D4 and the resistance R2, and an unbalanced current is generated passing through the resistance R2, the diode D2, the detecting part G, the diode D1 and the electric coil 9. The detecting part G detects each of these currents and applies them to the microcomputer of FIG. 3. The microcomputer calculates the space length x by means of the detecting part G, each time when it receives a detected signal of a determined phase from the rotary encorder (R.E), that is, at such a phase not influenced with vertical movements of the presser foot 1.

As mentioned above, according to the present invention, if the fabric thickness is changed during stitching, such changing is instantly detected. Therefore the present device is suitable for the automatic control. If the presser foot is changed but a detected value is not changed, any readjustment is not required.

Further, the electric iron core and the electric coil to be incorporated into the sewing machine are simple in structure, and if minor controlling parts are added only, the computer may be controlled.

It would be understood that each of the elements described above, or two or more together, may also find a useful application in other types of devices for detecting fabric thickness differing form the types described above.

While the invention has been illustrated and described as embodied in a sewing machine device for detecting a fabric thickness, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A device for detecting thickness of a fabric stitched in a sewing machine which feeds a fabric into a space between a needle plate and presser foot, at least one of the said needle plate and said presser foot containing a magnetizable substance, said device comprising an electric iron core having a pair of magnetic pole ends which are positioned in opposition to said component containing the magnetizable substance, said ends being spaced from said component containing magnetizable substance by a distance including a fabric thickness to be detected; an electric coil wound about said core; electric detecting means including said coil and detecting a changing amount of a relation between electric current in said coil due to a change in said distance depending on the thickness being detected and a magnetic flux in a magnetic path including said distance; and electronic calculating means which calculates the fabric thickness from a calculated changing amount of the detecting means.

2. The device as defined in claim 1, wherein said component containing magnetizable substance is the presser foot.

3. The device as defined in claim 1, wherein said component containing magnetizable substance is the needle plate.

4. The device as defined in claim 1, wherein said detecting means further includes a reference coil connected to said electric coil, and a bridge circuit.

5. The device a defined in claim 1, wherein said electronic means includes a microcomputer.

* * * * *